US005110165A

United States Patent [19]

Piltingsrud

[11] Patent Number: 5,110,165

[45] Date of Patent: May 5, 1992

[54] BIASED CHECK RAIL LOCK

[75] Inventor: Stephen M. Piltingsrud, Owatonna, Minn.

[73] Assignee: Truth Division of SPX Corporation, Owatonna, Minn.

[21] Appl. No.: 653,969

[22] Filed: Feb. 12, 1991

[51] Int. Cl.[5] ..... E05C 3/04

[52] U.S. Cl. ..... 292/242; 292/DIG. 49

[58] Field of Search ..... 292/241, 242, DIG. 49, 292/152, 147, 180, 103, 107, 129, 190, 240

[56] References Cited

U.S. PATENT DOCUMENTS

| | | | |
|---|---|---|---|
| 928,408 | 7/1909 | Taube | 292/242 |
| 1,257,051 | 2/1918 | Thomas et al. | 292/190 X |
| 2,679,416 | 5/1954 | Tassell | 292/242 |
| 4,736,972 | 4/1988 | Mosch | 292/241 X |
| 4,801,164 | 1/1989 | Mosch | 292/204 |

*Primary Examiner*—Richard E. Moore

*Attorney, Agent, or Firm*—Wood, Phillips, Van Santen, Hoffman & Ertel

[57] ABSTRACT

A window lock has a window sash mounted housing with a cam which is manually pivotable between a locking position engaging a keeper on a second window sash and an open position clear of the keeper. A bearing post projects from the cam and a spring secured to the housing exerts a biasing force against the post. The spring is a leaf spring having a first portion bearing against the post when the cam is positioned toward the locking position from the neutral position, and a second portion bearing against the post when the cam is positioned toward the open position from the neutral position. A curved portion of the spring connects the first and second portions at an angle relative to each other, and bears against the post when the cam is in the neutral position. The spring biasing force is directed substantially toward the cam pivot axis when the cam is in a neutral position between the locking and open positions, and is overcenter toward the open or locking position when the cam is selectively positioned toward the open or locking position, respectively, from the neutral position. The cam pivots substantially 180° between the open and locking positions, and the neutral position is about 70° from the locking position and about 110° from the open position.

14 Claims, 1 Drawing Sheet

Fig. 1
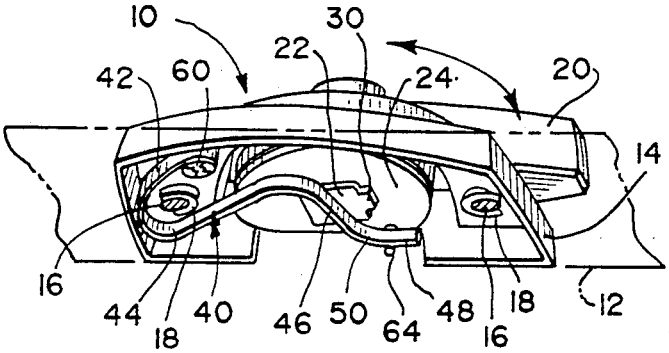
Fig. 5
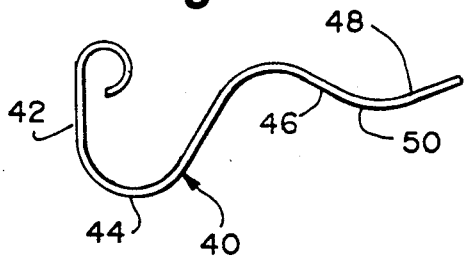
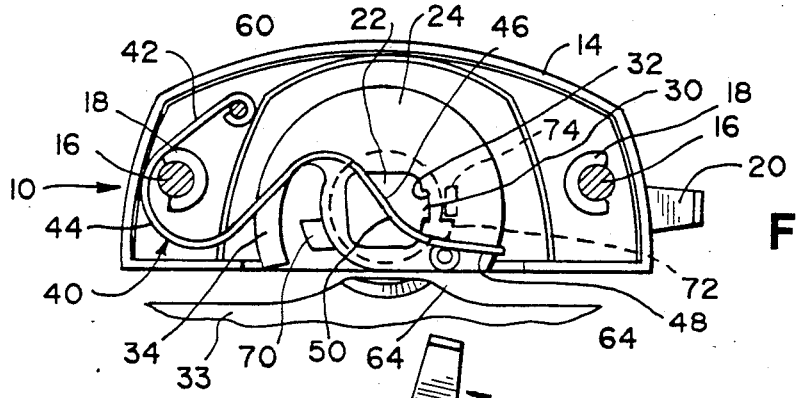
Fig. 2
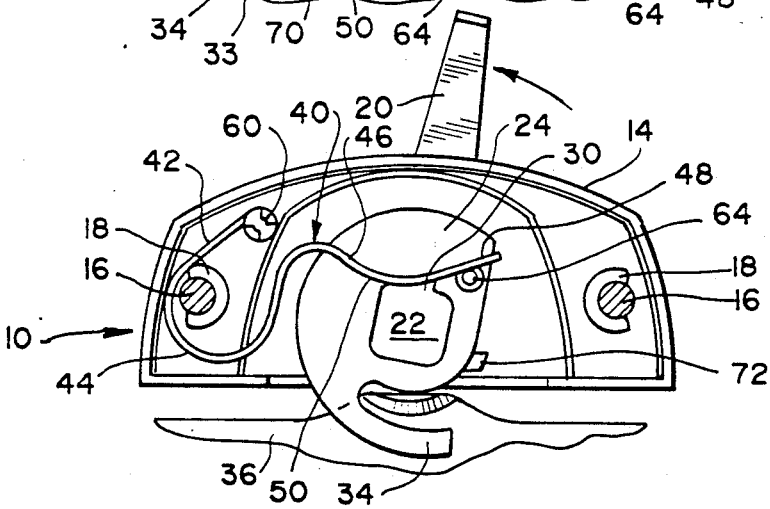
Fig. 3
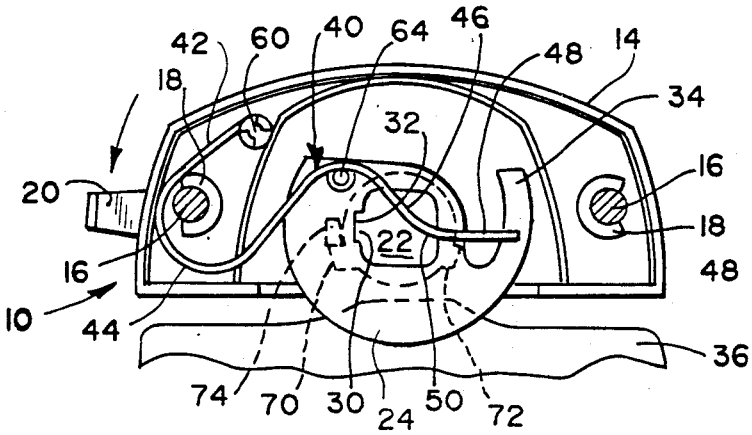
Fig. 4

BIASED CHECK RAIL LOCK

BACKGROUND OF THE INVENTION

1. Technical Field

The present invention is directed toward a check rail lock, and more particularly toward a check rail lock which is biased toward its open and locking positions.

2. Background Art

Check rail locks for locking double hung windows are well known in the art. These locks typically have a keeper mounted to the sash of the upper hung window, and a lock housing mounted to the sash of the lower hung window. The lock housing includes a cam which may be pivoted (typically through manual turning of an attached lever or handle by an operator) to either extend from the housing to grasp the keeper for locking, or to retract the cam into the housing clear of the keeper for unlocking.

Obviously, such locks do not serve their locking function if the cam is accidentally moved from its locking position (as might occur, for example, if the cam handle is accidentally bumped). Further, even partial movement of the cam toward the open position can reduce the security provided by the lock, since the taper of the lock cam can allow the window to be shaken by an intruder so as to conceivably further pivot the cam to the open position.

Similarly, the cam can damage the window if it is accidentally moved from the open position to the locking position when the window is open, since the projecting cam can then impact with the other window sash if the window position is thereafter changed (such impact and resulting damage can, in fact, be great given the fact that an open window is typically closed by rapid movement of the window (that is, by "slamming" the window).

Further, check rail locks such as described above are particularly susceptible to causing damage when used with certain types of windows if the lock is opened enough to clear the keeper but not enough to fully retract the cam into the housing (or is allowed to move back partially toward the locking position after it has initially been fully opened). For example, on double hung windows having a small horizontal distance between the glazing of the upper sash and check rail lock on the lower sash, the window glazing can be marked and otherwise damaged by the cam during movement if the cam projects even slightly from the lock housing. Similarly, in double hung windows having grill bars, a cam which projects only partially can still impact against the bars and mark or even break them during movement of the window.

Lock structures which have been used to ensure that the a check rail lock is properly disposed in its selected position are disclosed in Mosch U.S. Pat. Nos. 4,736,972 and 4,801,164, which locks use a spring washer with detents to provide a positive feel indicating that the lock has been properly positioned when fully moved to the selected locking or open position.

The present invention is directed toward overcoming one or more of the problems set forth above.

SUMMARY OF THE INVENTION

In one aspect of the present invention, a window lock has a window sash mounted housing with a cam which is manually pivotable between a locking position engaging a keeper on a second window sash and an open position clear of the keeper. A bearing post projects from the cam, and a spring is secured to the housing and engages the post to exert a biasing force against the post. The biasing force is directed substantially toward the cam pivot axis when the cam is in a neutral position between the locking and open positions, and is overcenter toward the open or locking position when the cam is selectively positioned toward the open or locking position, respectively, from the neutral position.

In another aspect of the present invention, the cam pivots substantially 180° between the open and locking positions, and the neutral position is about 70° from the locking position and about 110° from the open position.

In still another aspect of the present invention, the spring is a leaf spring having a first portion bearing against the post when the cam is positioned toward the locking position from the neutral position, and a second portion bearing against the post when the cam is positioned toward the open position from the neutral position. A curved portion of the spring connects the first and second portions at an angle relative to each other, and bears against the post when the cam is in the neutral position.

It is an object of the invention to provide a check rail lock which cannot be inadvertently locked or opened.

It is another object of the invention to provide a check rail lock which provides a positive feel indicating that the lock has been placed in the selected locking or open position.

It is still another object of the invention to provide a check rail lock which will not damage the window, window sill, window glazing, or other adjacent portions of the window.

BRIEF DESCRIPTION OF THE DRAWINGS

FIG. 1 is a perspective view from below a check rail lock embodying the present invention;

FIG. 2 is a plan view showing the bottom of the check rail lock of FIG. 1 in the open position;

FIG. 3 is a plan view similar to FIG. 2 but showing the lock in an intermediate position;

FIG. 4 is a plan view similar to FIG. 2 but showing the lock in the locking position; and FIG. 5 is a plan view of a leaf spring suitable for use with the present invention, showing the spring in its undistorted configuration.

DESCRIPTION OF THE PREFERRED EMBODIMENT

A check rail lock 10 embodying the present invention is shown from below in perspective in FIG. 1, with the upper surface 12 of a window sill to which it would be attached shown in phantom. The lock housing 14 is suitably secured to the sill, as by wood screws 16 or the like shown in cross section in bosses 18 in the housing 14.

A shaft (not shown) extends through, and is pivotable with respect to, the housing 14. A lever or handle 20 is suitably fixed to the upper end of the shaft (typically, the handle 20 and shaft are integrally formed).

The shaft lower end 22 is suitably fixed to a cam 24. To that end, the shaft lower end 22 is preferably non-cylindrical and mates with a similarly shaped opening in the cam 24 to ensure non-slipping rotation together. Further, the shaft lower end 22 also preferably includes an orientation lug 30 which positively engages cam orientation pocket 32 to ensure correct assembly of the cam 24 to the shaft.

The cam 24 may generally be of a configuration which is well known in the art, with a tapered grasping portion 34 adapted to grasp a keeper 36 (partially shown in FIGS. 2–4) for aligning and securing the two sashes of a double hung window in the convention manner.

A leaf spring 40 is provided having a base leg 42, a flexed portion 44, a first flat bearing portion 46, a second flat bearing portion 48, and a curved bearing portion 50 connecting the flat bearing portions 46, 48.

The spring base leg 42 is connected at one end to a post 60 in the housing 14. The spring 40 wraps around one of the housing bosses 18 so that the base leg 42 between the housing post 60 and housing boss 18 forms a base about which the flexed portion 44 (and spring 40 generally) flexes.

The first flat bearing portion 46, the second flat bearing portion 48, and the curved bearing portion 50 slidingly bear against a bearing post 64 projecting down from the cam 24 as is described in greater detail hereafter.

It has been found that a spring formed in the undistorted configuration of FIG. 5 of approximately 0.020" thick hardened stainless steel operates suitably with the present invention.

The lock 10 also preferably includes a pair of suitable stops 70, 72 (see FIGS. 2–4) for engaging a cam stop member 74 on top of the cam 24 (shown in dashed lines in FIGS. 2 and 4) when the cam 24 is in either its open position (FIG. 2) or its locking position (FIG. 4).

The lock 10 thus operates as follows.

In the open position as shown in FIG. 2, the spring 40 is flexed so that the second bearing portion 48 is biased against the bearing post 64. Accordingly, the cam 24 is biased clockwise as viewed in FIG. 2, so that the cam stop member 74 abuts the stop 72.

When an operator manually turns the handle 20 (counterclockwise as viewed in FIGS. 2–4) toward the locking position, the bearing post 64 slides along the spring second bearing portion 48 and bears against the spring 40 to flex it still further as seen in FIG. 3.

Eventually, rotation of the cam 24 causes the cam bearing post 64 to slide far enough along the spring 40 that the post 64 begins bearing against the spring curved bearing portion 50. Ultimately, a toggle point or neutral position is reached with the post 64 bearing against the curved bearing portion 50 such that the bearing force is substantially toward the pivot axis of the cam. At this neutral position, the spring 40 does not apply any moment force to the cam 24 and thus does not bias the cam toward either position.

Further turning of the handle 20 and cam 24 beyond the neutral position causes the bearing post 64 to slide beyond the curved bearing portion 50 to the spring first bearing portion 46. In this position, the spring 40 applies a counterclockwise bearing force (as viewed in FIGS. 2–4) against the post 64 (that is, the force has passed overcenter). Therefore, even should the operator release the handle 20 at this point, the spring 40 will bias the cam 24 completely and complete the rotation to the locking position shown in FIG. 4 with the cam stop member 74 abutting the stop 70.

Similarly, when the handle 20 is turned to pivot the cam 24 away from the locking position, the reverse action to that described above takes place. That is, initial clockwise pivoting of the cam 24 (as viewed in FIGS. 2–4) is done against the biasing force of the leaf spring 40 (specifically, the first bearing portion 46) until the neutral position is reached. Further pivoting beyond the neutral position results in a reversal of the biasing force of the leaf spring 40 (specifically, the second bearing portion 48), which exerts a moment force against the cam bearing post 64 toward the open position (see FIG. 2) and will even complete that rotation should the operator release the handle 20 early.

Preferably, the cam 24 can be pivoted about 180° between the locking and open positions, with the neutral position being located at about a 110° pivot from the open position (and about a 70° pivot from the locking position). Such a configuration gives the operator a good feel in using the lock 10 by allowing him or her to pivot the handle 20 a substantial amount (at least about 70° ) until the spring 40 begins to bias the cam 24.

While different configurations could be used, establishing the neutral position too close to either the locking or open positions can have the undesirable effect of giving the operator a feeling of losing control of the handle too quickly. It could also result in undesirable changes of position of the lock 10 as a result of only slight inadvertent brushing against the handle 20. Nevertheless, locating the neutral position closer to the locking or open positions may be acceptable in some applications and to some users, an thus it should be understood that other spring orientations could be used within the broad scope of the invention.

Further, due to frictional forces (between the spring 40 and bearing post 64 as well as other frictional forces in the lock 10) and the small moment arm through which the bearing force acts near the neutral position, it should be understood that there is no single precise neutral position, but instead there is a small angular range within which the spring 40 will not alone force the cam 24 to one position or the other. Should such a distinct neutral position be desirable, it could readily be included within the scope of the present invention by, for example, connecting the first and second spring bearing portions with a sharp bend rather than by the curved portion 50 shown.

It should also be understood that the leaf spring 40 shown in the Figures is merely a preferred embodiment for creating the biasing force required for the above described operation. Alternatively, for example, a tension spring or a compression spring positioned to operate in a suitable overcenter manner between the housing 14 and cam 24 could also be used.

It can thus be seen from a full understanding of the present invention that the lock disclosed herein will reliably be fully maintained in either the selected open position or the selected locking position. By ensuring that the cam 24 is maintained in the selected open position, either of the double hung windows can be safely moved without danger of a slightly projecting cam grasping portion 34 scratching, damaging the finish, or even breaking parts of the window such as grill bars.

Similarly, by ensuring that the cam 24 is maintained in the selected locking position, the lock 10 will provide reliable security even should the handle 20 be inadvertently brushed against. That is, not only will the cam 24 maintain its grasp with the keeper 36, but it will also maintain the lock 10 fully in the locking position to ensure that the window cannot even be shaken to open the cam little by little. Of course, such little by little opening of the cam by an intruder is further protected against by the present invention inasmuch as shaking the window to loosen the cam 24 would merely result in the cam 24 being maintained in its locking position.

Similar security is also provided against an intruder's entry through use of a knife or the like between the window sashes. Again, such an attempt to move the lock little by little would be foiled by the action of the spring 40 continuously returning the cam 24 to its locking position.

Check rail locks made according to the present invention also provide ideal operation by providing a positive feel for the user when he or she changes it from one position to the other. This positive feel is further enhanced by the interaction of the stops 70, 72 with the cam stop member 74, which can snap together when the cam 24 is forced into either position.

Still further, that "snap" of the stop member 74 on either of the stops 70, 72 can provide further security against inadvertent changing of the position of the lock 10. That is, if the handle 20 is inadvertently bumped in a manner sufficient to move the handle 20, the spring 40 will move the cam 24 to one of the positions (depending on which side of the neutral position the handle 20 is moved to by the bumping) and may produce an audible "snap" which would draw the attention of the person who bumped the lock 10.

Still other aspects, objects, and advantages of the present invention can be obtained from a study of the specification, the drawings, and the appended claims.

I claim:

1. In a window lock having a cam pivotable relative to a housing between a first position extending from said housing to engage a keeper to lock said window and a second position with substantially all of said cam located within said housing, the improvement comprising means for biasing said cam toward said second position when said cam is not in said first position and up to at least 60° from said second position, where said biasing means does not bias said cam toward said second position when said cam is within at least 50° of said first position.

2. The improved window lock of claim 1, wherein said biasing means comprises a leaf spring.

3. The improved window lock of claim 1, further comprising a member on said cam, and wherein said biasing means comprises a spring engaging said member.

4. In a window lock having a cam with a member thereon, said cam being pivotable relative to a housing between a first position extending from said housing to engage a keeper to lock said window and a second position with substantially all of said cam located within said housing, the improvement comprising a spring engaging said cam member to bias said cam toward said second position when said cam is not in said first position and up to at least 30° from said second position, said cam further applying a biasing force against said member substantially toward the pivot axis of said cam when said cam is in a neutral position between said first position and said second position.

5. The improved window lock of claim 4, wherein said spring applies a biasing force against said member which is overcenter from the cam pivot axis when said cam is moved from its neutral position.

6. In a window lock having a cam pivotable relative to a housing between a first position extending from said housing to engage a keeper to lock said window and a second position with substantially all of said cam located within said housing, the improvement comprising means for biasing said cam toward said second position when said cam is non in said first position wherein said cam pivots substantially 180° between said first and second positions, and said cam is in said neutral position when positioned substantially 70° from said first position and substantially 110° from said second position.

7. The improved window lock of claim 6, further comprising a stop on said housing engageable with a stop on said cam in said second position, wherein said stops provide a positive feel for said lock when said biasing means biases said cam to said second position.

8. The improved window lock of claim 6, wherein said biasing means biases said cam toward said second position when said cam is pivoted within at least about 90° of said second position.

9. The improved window lock of claim 6, wherein said biasing means biases said cam toward said first position when said cam is pivoted within at least about 50° of said first position.

10. The improved window lock of claim 9, further comprising stops on said housing engageable with a stop on said cam in said first and second positions, wherein said stops provide a positive feel for said lock when said biasing means biases said cam to either said first or second positions.

11. In a check rail lock having a cam manually pivotable about an axis with respect to a housing mountable on a first window sash, said cam pivoting between a locking position engaging a keeper on a second window sash and an open position clear of said keeper, the improvement comprising:

a bearing post on said cam; and a spring secured to said housing and engaging said post to exert a biasing force against said post;

wherein said biasing force is substantially toward the pivot axis in a neutral position between said locking and open positions, overcenter toward said locking position when said cam is positioned toward said locking position from said neutral position, and overcenter toward said open position when said cam is positioned toward said open position from said neutral position.

12. In a check rail lock having a cam manually pivotable about an axis with respect to a housing mountable on a first window sash, said cam pivoting between a locking position engaging a keeper on a second window sash and an open position clear of said keeper, the improvement comprising:

a bearing post on said cam; and a spring secured to said housing and engaging said post to exert a biasing force against said post;

wherein said biasing force is substantially toward the pivot axis in a neutral position between said locking and open positions, overcenter toward said locking position when said cam is positioned toward said locking position from said neutral position, and overcenter toward said open position when said cam is positioned toward said open position from said neutral position, and wherein said cam pivots substantially 180° between said open and locking positions, and said neutral position is about 70° from said locking position and about 110° from said open position.

13. The improved check rail lock for use with a keeper as recited in claim 11, wherein said spring is a leaf spring having:

a first portion bearing against said post when said cam is positioned toward said locking position from said neutral position;

a second portion bearing against said post when said cam is positioned toward said open position from said neutral position; and a curved portion connecting said first and second portions at an angle relative to each other, wherein said curved portion bears against said post when the cam is in the neutral position.

14. The improved check rail lock for use with a keeper as recited in claim 13, further comprising a stop on said cam engaging stops on said housing when said cam is in either its open position or its locking position, wherein said spring biases said cam to provide a user a positive feel indicating that the cam has been properly pivoted to the selected open or locking position.

* * * * *